United States Patent [19]

Mohr

[11] 4,076,491

[45] Feb. 28, 1978

[54] LIGHTER WITH SWINGABLE ACTUATOR

[75] Inventor: Walter Mohr, Frankfurt am Main, Germany

[73] Assignee: Braun Aktiengesellschaft, Frankfurt am Main, Germany

[21] Appl. No.: 700,779

[22] Filed: Jun. 29, 1976

[30] Foreign Application Priority Data

Aug. 21, 1975 Germany ..... 2537215

[51] Int. Cl.[2] ..... F21H 7/00

[52] U.S. Cl. ..... 431/130; 431/255; 310/328

[58] Field of Search ..... 431/255, 129, 130, 131, 431/132, 277; 310/8.7; 317/81, DIG. 11; 315/209; 361/260

[56] References Cited

U.S. PATENT DOCUMENTS

| | | | |
|---|---|---|---|
| 3,280,881 | 10/1966 | Hach et al. | 431/255 |
| 3,295,024 | 12/1966 | Newman | 310/8.7 |
| 3,592,576 | 7/1971 | Hocq | 431/131 |
| 3,612,736 | 10/1971 | Stevernagel | 431/132 |
| 3,859,035 | 1/1975 | Schlamp | 431/255 |
| 3,859,037 | 1/1975 | Mohr | 62/48 |
| 3,898,534 | 8/1975 | Mohr | 431/255 |

*Primary Examiner*—Edward G. Favors
*Assistant Examiner*—Robert J. Charvat
*Attorney, Agent, or Firm*—Karl F. Ross

[57] ABSTRACT

A lighter having an igniter of the piezoelectric type has a swinging portion of its housing serving as the actuator and operating on the igniter by a force-transmitting arrangement having a cam and a cam follower to transform the pivotal movement of the actuator into a linear displacement of the movable member of the igniter.

18 Claims, 5 Drawing Figures

LIGHTER WITH SWINGABLE ACTUATOR

Field of the Invention

The present invention relates to a lighter and, more particularly, a portable or pocket cigarette or cigar lighter, of the nondisposable type which comprises a resevoir for a fuel, a nozzle at which a flame can be generated by combustion of the fuel, and a igniter operated upon the displacement of an actuator to ignite the fuel at the nozzle. More specifically, the invention relates to an improved lighter system of the type which uses an electrical igniter.

BACKGROUND OF THE INVENTION

Cigarette and cigar lighters of the aforedescribed type are known in a variety of configurations and sizes and with various mechanisms for operating the igniter upon movement of an actuator forming a part of the lighter structure.

In German printed application (Offenlegungsschrift) DOS No. 2242895, for example, a lighter provided with a piezoelectric igniter is disclosed which comprises a cap which can be opened against the force of a spring to render accessible a double-arm lever normally lying beneath this cap. An end of the double-arm lever extending within the lighter housing structure has a roller which bears against an end of a second double-arm lever whose other arm bears in turn upon the movable member of a piezoelectric igniter. The first lever may thus be actuated when the cap is opened to transmit force via the lever pin to the movable part of the piezoelectric device.

This system has the disadvantage that it requires two distinct manipulations, namely, the lifting of the cap and the subsequent ignition actuation of the double arm lever. Furthermore, the force-transmitting mechanism is relatively complex and expensive and is prone to failure because of its complexity. Another disadvantage is that the mechanism occupies considerable space and its use makes the lighter larger than is desirable.

In German printed application (Offenlegungsschrift) DOS No. 2105814, another lighter system is described in which a lever is swingably mounted of the housing between two limits and is connected via a shaft, a coil spring, swingable cams and other elements to a spring-loaded swingable hammer which bears upon a piezoelectric igniter unit. Experience has shown that this actuator system is characterized by high friction forces which cause considerable wear of the many moving parts, may cause jamming of the unit and consequent failure, and renders the device difficult to operate. This construction also is relatively complex and expensive.

Still another electrical igniter type lighter is disclosed in German printed application (Offenlegungsschrift) DOS No. 2248313 in which a ball is provided between a vertically shiftable part of the piezoelectric igniter unit and an actuating element which is swingable about a horizontal axis. The bore serves only to reduce the friction force between the actuator and the shiftable part of the igniter and does not serve any force-transmitting function. The actuator is designed to apply pressure to the shiftable member until the latter is released. This arrangement has the advantage that friction forces are reduced by comparison with the more complex mechanisms previously described but nevertheless provides a relative expensive and frequently unreliable system which can be unaesthetic and difficult to use.

German utility model (Gebrauchsmuster) No. 6607167 discloses an actuator which is swingable about a vertical axis to operate upon a torsion bar which acts upon the igniter structure. The torsion bar, its support and journaling system are complex and difficult to fabricate and its connection with the actuator have been found to be prone to breakdown.

The foregoing examples of prior-art systems for the operation of electrical-igniter lighters demonstrate that in spite of considerable efforts made in this field, the problem of creating a relatively simple, reliable and inexpensive actuating arrangement for such lighters has not been solved heretofore.

Objects of the Invention

It is the object of the present invention, therefore, to provide an electrical-igniter lighter, preferably of the nondisposable type, with an ignition system which avoids the disadvantages of the prior art and especially the abovedescribed system, which can be actuated with a minimum of force, which is less prone to wear and breakdown than the earlier lighters, which is easily mounted and assembled and which is of simple and inexpensive construction.

SUMMARY OF THE INVENTION

This object and others which will become apparent hereinafter are attained, in accordance with the present invention, by providing a force-transmitting device between a pivotal actuator and the vertically shiftable member of a piezoelectric igniter, the force-transmitting device comprising a curved-sector or track member and a follower-roller member engaging the track of the first member, one of these members being entrained by the actuator while the other engages the rectilinearly slidable movable member of the igniter.

In a preferred embodiment of the invention, the rotatably journaled member is mounted on a structural element or body which is seated upon the movable member of the igniter while the element forming the curved track is connected with the swingably arranged actuator.

Preferably, the element carrying the curved track constitutes a cam describing an arc with a fixed radial distance from the pivotal axis of the actuator.

According to another feature of the invention, the actuator is a swingable portion of the lighter housing so as to form continuous walls with the stationary portions thereof in the closed position of the actuator.

According to still another feature of the invention, the shiftable housing portion of the igniter and the element carrying the rotatable member or cam follower forms a single piece. Of course, when the actuator is provided with the cam follower roller and the cam bears against the movable portion of the igniter, the cam or curved track can be of a single piece with the movable element of the actuator.

To limit the friction between the element carrying the rotatable member and the housing wall of the lighter, the latter element can be provided with one or more additional rolling members which rest against the walls of the housing and ensure that only rolling friction will be experience between this element and the housing walls.

According to an important aspect of the invention, the curved track or cam has an arcuate configuration, i.e. the axial displacement of the cam follower with per unit angular swing of the actuator is not constant but rather progressively increases so that the thrust upon the movable member of the igniter is increased and the latter is accelerated to the point at which the igniter fires. Since more greater force may be required only in the latter stages of the swinging movement of the actuator and such greater force can be readily applicable once the actuator has been swung out of its closed position, the operation of the device is easier and more comfortable than the operation of earlier swinging actuator arrangements.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
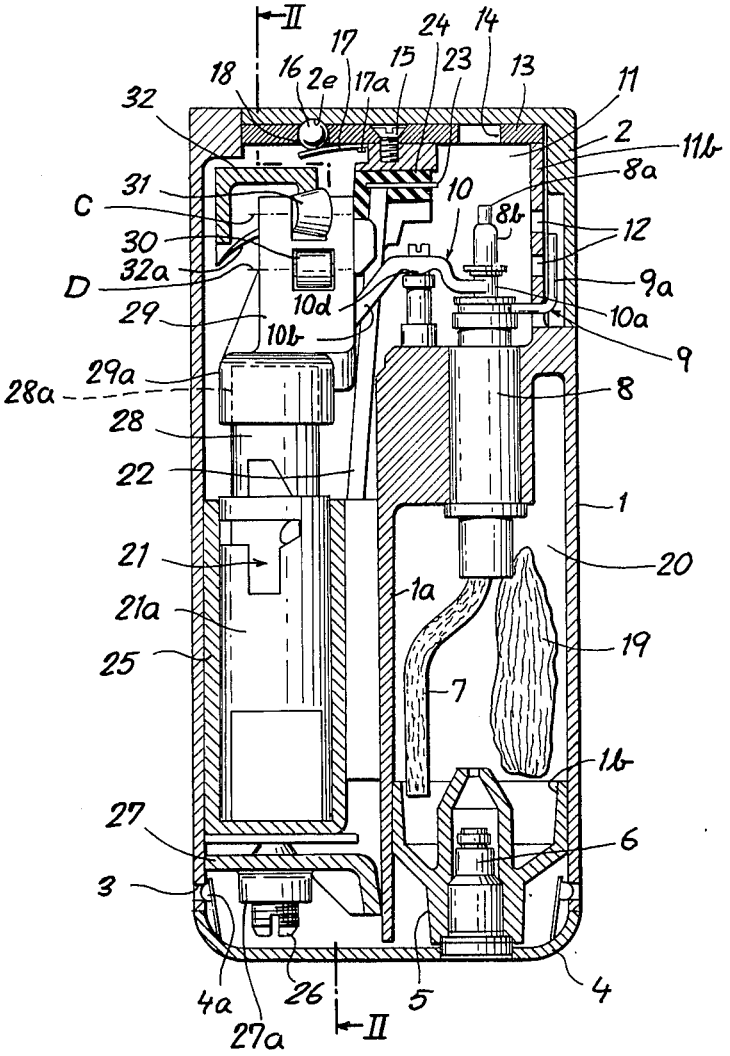
FIG. 1 is a vertical cross-section of the lighter according to the invention with portions which are exposed when the wall of the housing is broken away being shown in elevation, the actuator being in its closed or inoperative position.

In FIG. 1 I have shown a lighter having a housing 1 defining a tubular compartment 1*a* into which the aprol 1*b* of a tank bottom 5 is sealingly fitted to define a fuel tank 20 along the right-hand half of the housing.

Figure 2:
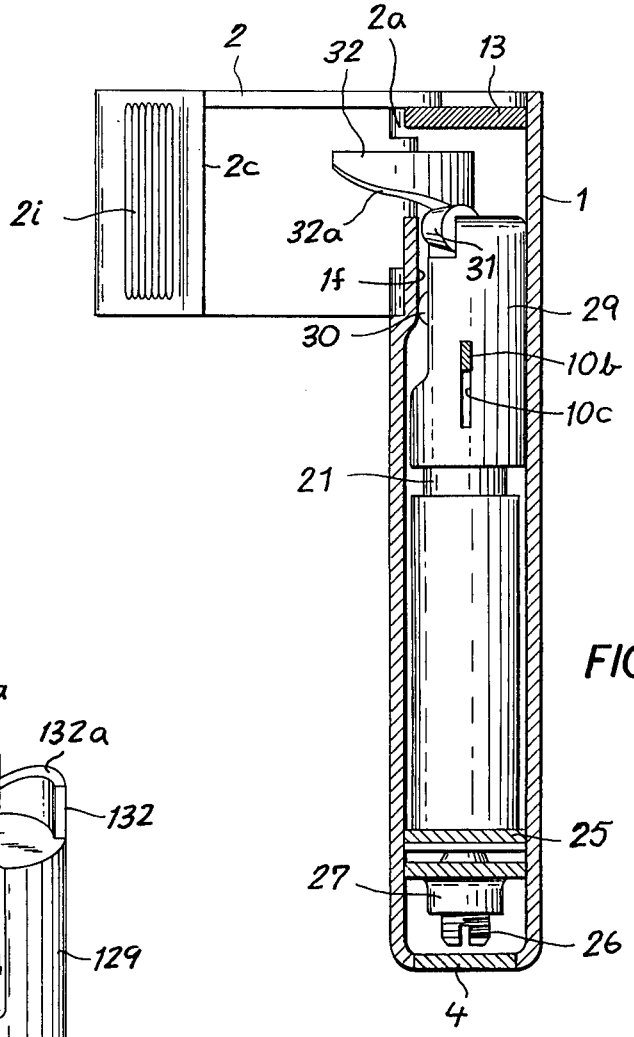
FIG. 2 shows a section taken generally along the line II — II of FIG. 1 with the actuator, however, shown in its outwardly swing or actuated position.

The housing 1 is provided with a swingable portion 2 (see FIGS. 2 and 4) which constitutes the igniter actuator according to the invention. Recesses 3 are provided along the bottom of a housing 1 and receive outwardly biased tenons or tongues 4*a* of a bottom member 4 which can be snapped in place.

The tank bottom 5 is provided with a filling valve 6 which can be of any conventional type commonly used in charging the lighter with butane.

The burner valve 8, which can be of the type described in U.S. Pat. No. 3,859,035, is provided with a wick 7 reaching into the fuel tank, the burner valve 8 having an orifice 8*a* from which the combustible gas can issue.

The burner valve lever is here represented at 10 and can be a double-arm lever, one arm 10*a* of which engages the orifice of the burner valve 8 as described in U.S. Pat. No. 3,859,035, while the other arm 10*b* is received in a slot 10*c* of force-transmitting member 29 to be described in greater detail below. The lever 10 is fulcrumed at 10*d* so that depression of member 29 will open the valve.

Figure 4:
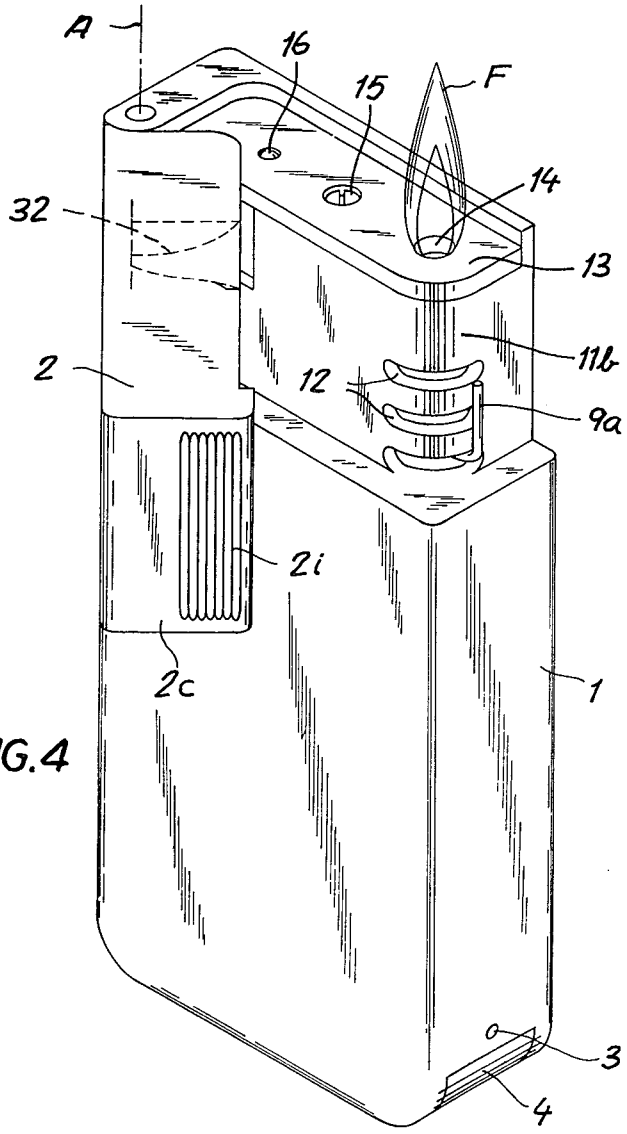
FIG. 4 is a perspective view of the lighter in the actuated position.

The housing 1 is formed with a wall 11*b* which surrounds a chamber 11 about the burner orifice 8*a* and vented to the atmosphere through openings 12 which permit oxygen to reach the gases emerging from the orifice and produce the necessary gas/fuel mixture which can be ignited to form the flame F (FIG. 4). The chamber 11 is closed at its top by a plate 13 formed with a flame-passing opening 14 and held in place by a screw 15 of the housing 1.

Figure 3:
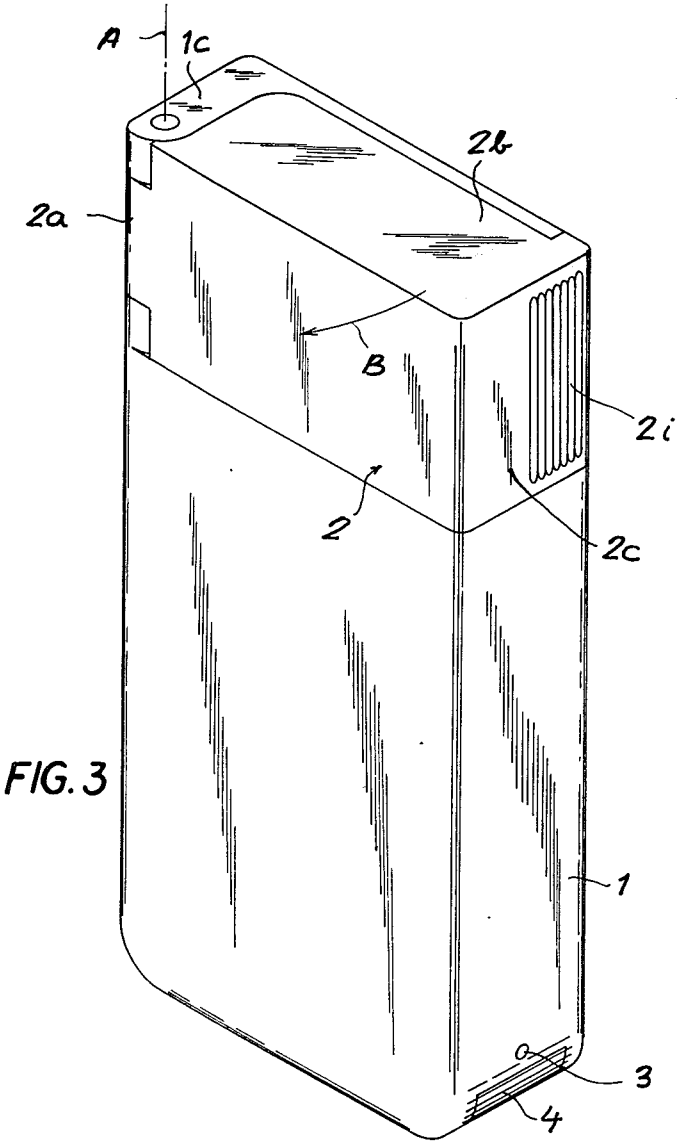
FIG. 3 is a perspective view of the lighter in the unactuated position.

The actuator 2 is, as illustrated in FIG. 4, hinged at 2*a* to the housing 1 for swinging movement about an axis A and has a cover plate 2*b* which is designed to overlie the plate 13 and provide an aesthetic closure for the top of the lighter. The plate 2*b* may be flush with the upper end 1*c* of housing 1. In addition, the actuator 2 can have a hook-shaped portion 2*c* adapted to reach around the chamber 11 when the lighter is in its closed position (FIG. 2) and provided with milled formations or corrugations 2*i* to enable the actuator to be flipped open in the direction of arrow B by the thumb of the user. A ball 16 bears against the underside of the plate 2*b* and can be received in a slight recess 2*e* therein to index the actuator 2 in its closed position (FIG. 3). The detent ball 16 is shiftable in a bore 18 of the plate 13 (FIG. 1) and is urged upwardly by a plate spring 17 mounted in a recess 17*a* of the housing 1.

To prevent oils and fatty materials in the fuel from contaminating the burner valve and the electrodes, the fuel tank 20 is provided with sorption means in a gas-permeable envelope, at 19. The effect of such sorption means is described in U.S. Pat. No. 3,859,037.

The piezoelectric igniter 21 is connected by a conductor 22 with an electrode 23 extending into chamber 11 and mounted in a block 24 of electrically insulating material fixed in the housing 1. The second electrode for the ignition spark is constituted by the metal tip 8*b* forming the orifice 8*a* of the burner valve 8. Electrical communication to this member 8*b* can be effected via the lever 10 and the metallic body 29 which bears upon the metallic movable member 28 of the igniter or another suitable conductive path.

The fixed portion 21*a* of the piezoelectric igniter 21 is received in a sleeve 25 which can be moved upwardly or downwardly by a set screw 26, normally concealed by the bottom cap 4 of the lighter. The set screw 26 is threaded into a partition having a threaded body 27*a* receiving the screw 26. The screw 26 is thus able to adjust the height of the igniter and force transmission assembly relative to the actuator 2. Member 28 is rectilinearly displaceable downwardly to generate the ignition impact, i.e. the igniter is of the impact type.

The actuator 21 has a vertically shiftable housing part 28 upon which the force-transmitting device 29 is pressed. To this end, member 28 may have a cylindrical profile 28*a* over which the socket 29*a* of the member 29 can be snugly pressed.

The body 29 is provided with a pair of rotatably journaled elements 30 and 31. Element 31, which is rotatable about a horizontal axis C, fixed relative to the body 29 is of frustoconical configuration and forms a cam follower roller engaging the arcuate track 32*a* of the cam 32, the latter being fixed to the swinging actuator 2. Element 30 is rotatable about another horizontal axis D fixed on body 29 and rollingly engages the wall 1*f* of the housing 1.

When the actuator 2 is swung out of the contour of the housing 1 (compare FIGS. 3 and 4) the cam track 32*a* rides upon the follower 31 to drive member 29 and the movable portion 28 of the igniter downwardly and produces a spark between the tip 8*b* and the electrode 23 as described in U.S. Pat. Nos. 3,898,534 and 3,936,978.

Friction between the force-transmitting mechansim and the wall of the housing, which in any case is low because the forces are principally vertical are reduced still further by the rotatable element 30 which rolls upon the wall of the housing juxtaposed with member 29. The force-transmitting mechanism 29 etc. is preferably composed of synthetic resin and the rotatable elements 30 and 31 may be formed in recesses of the body 29 to simplify insertion.

After the actuator 2 has been swung partly open, the valve 8 is opened by lever 10 to release the gases which are ignited by the spark. A lever 9 is connected to valve 8 and has an arm 9*a* operable externally of the housing to adjust the flame height. The flame height adjustment mechanism can be of the type described in U.S. Pat. No. 3,859,035.

Figure 5:
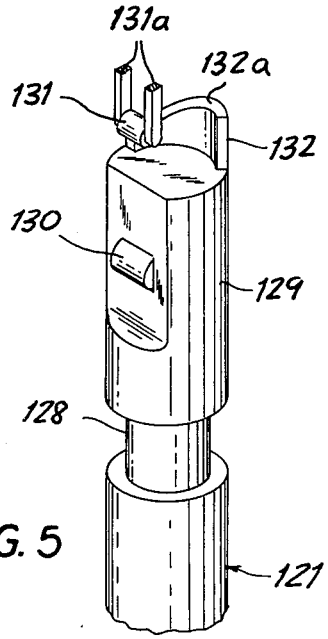
FIG. 5 is a perspective view of the igniter and force-transmitting mechanism according to another feature of the invention.

In FIG. 5 I show a kinematic reversal of the system of FIG. 1. In this case the cam 132 carrying the curved track 132*a* is mounted upon the synthetic resin body 129 carrying the antifriction roller 130 and is preferably integral therewith. The member 129 can also be formed as one piece with the movable member 128 of the piezoelectric igniter 121.

A frustoconical roller 131 is here coupled, e.g. by lugs 131*a*, with the swingable actuator (not shown) to ride upon the track 132*a*.

I claim:

1. A lighter comprising:

a housing formed with a fuel tank;

a burner valve on said housing communicating with said tank for discharging a jet of flammable fuel;

a piezoelectric igniter in said housing having a movable part linearly displaceable to generate a discharge igniting said jet;

a swingable actuator on said housing and forming part thereof for operating said valve and said igniter; and a force-transmitting device between said actuator and said movable part of said igniter, said device comprising a body, a curved-track element and a rolling running along said curved-track element, one of said elements being mounted on said actuator and the other of said elements being mounted on said body, said body bearing against said part to transform angular displacement of said actuator into linear displacement of said part, and a further rolling element riding along a wall of said housing.

2. The lighter defined in claim 1 wherein said rolling element is a roller mounted on said body, said body being set onto said part of said igniter.

3. The lighter defined in claim 1 wherein said curved-track element is mounted on said actuator.

4. The lighter defined in claim 1 wherein said curved-track element is mounted on said body and said body is seated on said part, said rolling element being mounted on said actuator.

5. The lighter defined in claim 1 wherein said curved-track element is a cam mounted on said actuator and disposed at a constant radial distance from the swinging axis thereof.

6. The lighter defined in claim 1 wherein said body is formed in one piece with said part of said igniter.

7. The lighter defined in claim 1 wherein said curved-track element has a camming track of arcuate configuration.

8. The lighter defined in claim 1 wherein said body is provided with a formation operating said valve upon a predetermined displacement of said body by said actuator.

9. A cigar or cigarette lighter comprising:

a vertically elongated housing formed with a fuel tank;

a burner valve on an upper part of said housing communicating with and disposed above said tank for discharging a jet of flammable fuel;

an impact-type piezoelectric igniter in said housing having a movable part linearly displaceable generally vertically to generate a discharge igniting said jet;

a swingable actuator on said housing and forming part thereof for operating said valve and said igniter, said actuator being swingable about a vertical axis on said housing and exposing said burner in one position while closing and concealing said burner in another position; and a force transmitting device between said actuator and said movable part of said igniter, said device comprising a body, a curved-track element, one of said elements being mounted on said actuator and the other of said elements being mounted on said body, said body bearing against said part to transform angular displacement of said actuator into linear displacement of said part.

10. The lighter defined in claim 9 wherein said rolling element is a roller mounted on said body, said body being set onto said part of said igniter.

11. The lighter defined in claim 9 wherein said curved-track element is mounted on said actuator.

12. The lighter defined in claim 9 wherein said curved-track element is mounted on said body and said body is seated on said part, said rolling element being mounted on said actuator.

13. The lighter defined in claim 9 wherein said curved-track element is a cam mounted on said actuator and disposed at a constant radial distance from the swinging axis thereof.

14. The lighter defined in claim 9 wherein said body is formed in one piece with said part of said igniter.

15. The lighter defined in claim 9 wherein said body is provided with a further rolling element riding along a wall of said housing.

16. The lighter defined in claim 9 wherein said curved-track element has a camming track of arcuate configuration.

17. The lighter defined in claim 9 wherein said body is provided with a formation operating said valve upon a predetermined displacement of said body by said actuator.

18. The lighter defined in claim 9 wherein said housing is formed with a cover plate provided with an orifice through which a flame formed upon ignition of said jet emerges, said actuator enclosing said cover plate in a closed position of the actuator.

* * * * *